US008756848B2

(12) United States Patent
Bovensiep

(10) Patent No.: US 8,756,848 B2
(45) Date of Patent: Jun. 24, 2014

(54) RIFLE CHASSIS HAVING INTERCHANGABLE STOCKS

(76) Inventor: William Bovensiep, Rochester Hills, MI (US)

( * ) Notice: Subject to any disclaimer, the term of this patent is extended or adjusted under 35 U.S.C. 154(b) by 90 days.

(21) Appl. No.: 13/194,956

(22) Filed: Jul. 31, 2011

(65) Prior Publication Data

US 2013/0025177 A1 Jan. 31, 2013

(51) Int. Cl.
*F41C 23/00* (2006.01)
*F41C 7/00* (2006.01)

(52) U.S. Cl.
USPC ..... 42/71.01; 42/75.03

(58) Field of Classification Search
USPC ..... 42/71.01, 72, 75.03
See application file for complete search history.

(56) References Cited

U.S. PATENT DOCUMENTS

| | | | | |
|---|---|---|---|---|
| 5,173,564 | A * | 12/1992 | Hammond, Jr. | 42/75.03 |
| 6,250,194 | B1 * | 6/2001 | Brandl et al. | 89/1.41 |
| 6,374,528 | B1 * | 4/2002 | Davis et al. | 42/71.01 |
| 6,839,998 | B1 * | 1/2005 | Armstrong | 42/71.01 |
| 7,162,823 | B2 * | 1/2007 | Schoppman et al. | 42/75.01 |
| 7,665,240 | B1 * | 2/2010 | Bentley | 42/75.03 |
| 7,726,060 | B1 * | 6/2010 | Jones | 42/75.02 |
| 7,926,217 | B2 * | 4/2011 | McCann | 42/75.03 |
| 2003/0101631 | A1 * | 6/2003 | Fitzpatrick et al. | 42/72 |
| 2003/0140542 | A1 * | 7/2003 | Kay | 42/75.03 |
| 2008/0190005 | A1 * | 8/2008 | Rohrauer | 42/75.01 |
| 2010/0162608 | A1 * | 7/2010 | McCann | 42/71.01 |
| 2010/0275490 | A1 * | 11/2010 | Rotharmel | 42/75.03 |
| 2011/0283582 | A1 * | 11/2011 | Hunter et al. | 42/69.02 |
| 2011/0302817 | A1 * | 12/2011 | DeBrun et al. | 42/74 |

* cited by examiner

*Primary Examiner* — Bret Hayes

(57) ABSTRACT

A rifle chassis is able to convert the M1A rifle to have a modular stock system. The chassis may be designed to permit attachment of a shotgun stock to the M1A chassis. For example, a particular model's modular stock system, such as a Mossberg® model 500 shotgun stock, may be attached to the chassis of the present invention to permit interchangeability of stocks on the rifle.

15 Claims, 4 Drawing Sheets

RIFLE CHASSIS HAVING INTERCHANGABLE STOCKS

BACKGROUND OF THE INVENTION

The present invention generally relates to rifles and, more particularly, to a chassis for a M1A rifle to permit the rifle have a modular stock system.

Currently, the stocks that are available for the M1A rifle are single use. A user is not able to quickly and easily change gun stocks. For example, if a user desires to change from a solid stock to a pistol grip stock, the user would be required to disassemble the rifle and reassemble the action into the different stock.

As can be seen, there is a need for a chassis for a M1A rifle that allows the user to quickly and easily change the rifle's stock.

SUMMARY OF THE INVENTION

In one aspect of the present invention, a rifle design comprises a chassis extending to a back end of an action of the rifle; and a receiver end of the chassis adapted to accept aftermarket stocks interchangeably attachable thereto.

In another aspect of the present invention, a rifle chassis comprises a receiver end adapted to accept aftermarket stocks interchangeably attachable thereto.

In a further aspect of the present invention, a rifle comprises a rifle chassis having a receiver end adapted to accept aftermarket stocks interchangeably attachable thereto; a rifle action mounted into the chassis; and an interchangeable aftermarket stock removably attached to the receiver end of the rifle chassis.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a chassis that is able to convert the M1A rifle (Springfield Armory USA) to have a modular stock system. The chassis may be designed to permit attachment of a shotgun stock to the M1A chassis. For example, a particular model's modular stock system, such as a Mossberg® model 500 (O.F. Mossberg & Sons, Inc.) shotgun stock, may be attached to the chassis of the present invention.

Figure 1:
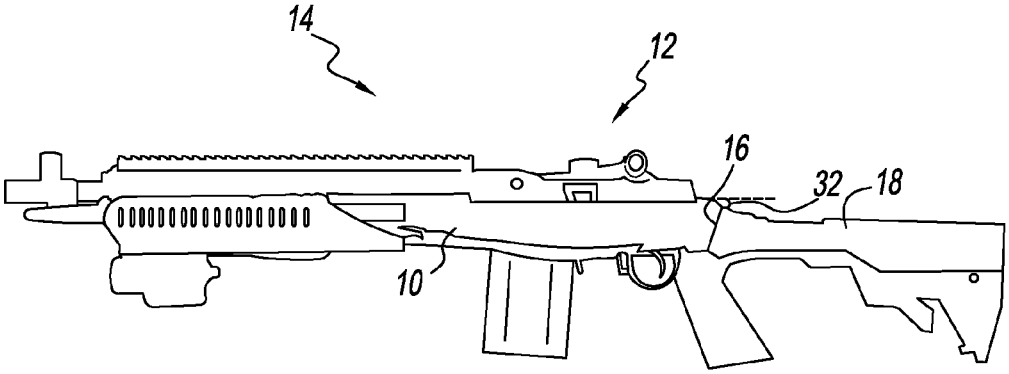
FIG. 1 is a side view of an assembled M1A rifle having a chassis according to an exemplary embodiment of the present invention.
Figure 2:
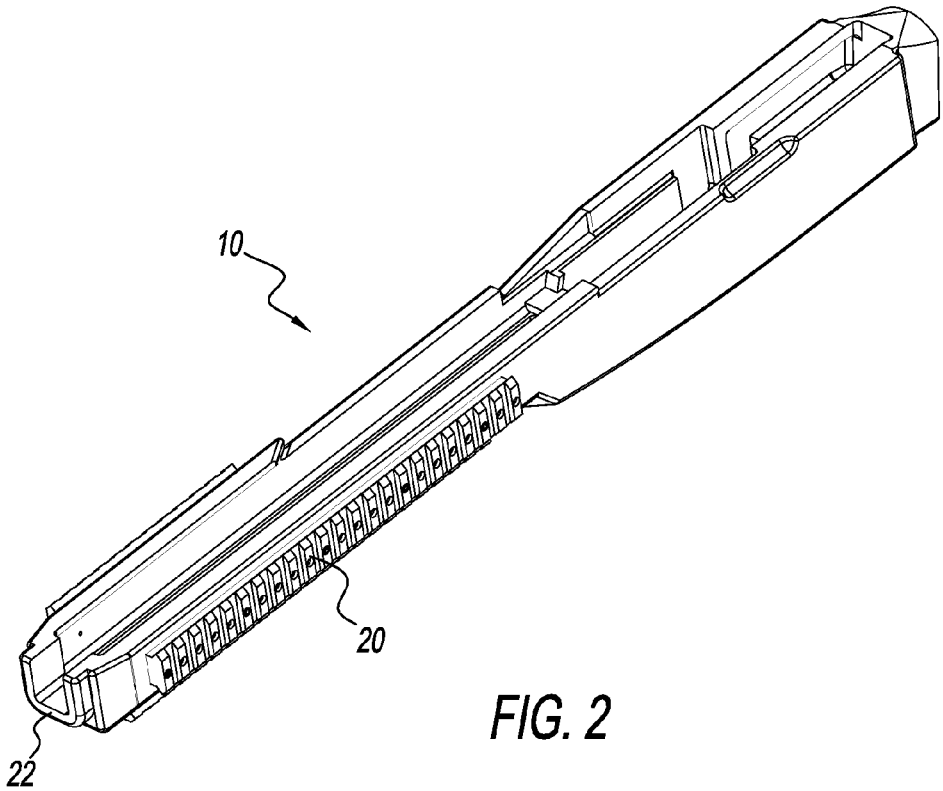
FIG. 2 is a left side perspective view of the chassis of FIG. 1.
Figure 3:
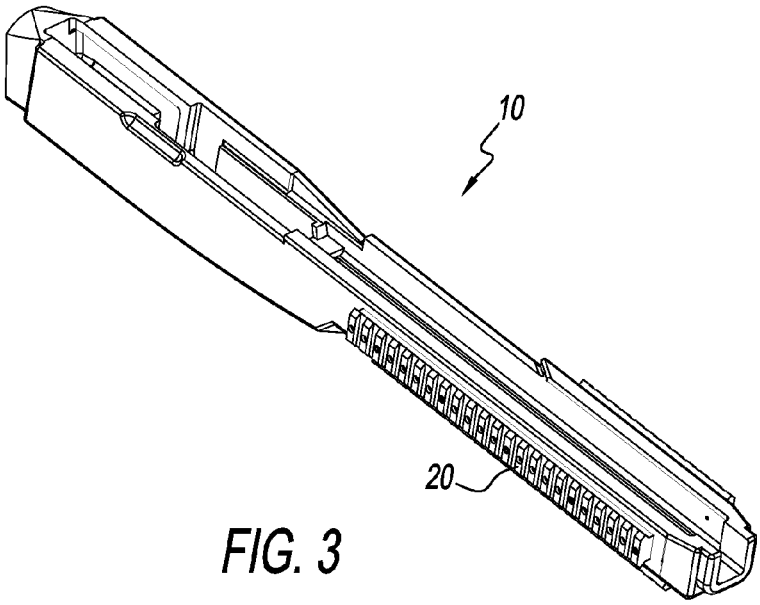
FIG. 3 is a right side perspective view of the chassis of FIG. 1.
Figure 4:
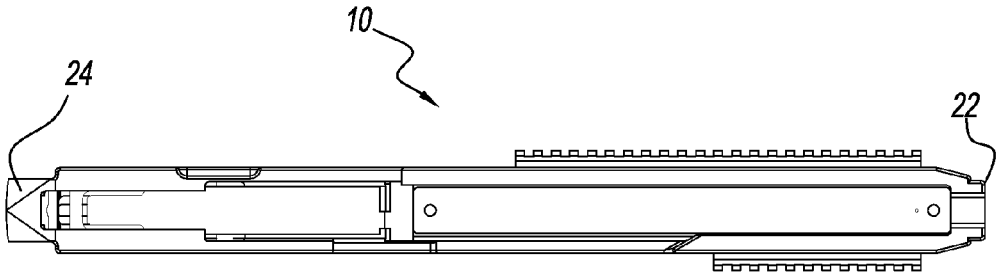
FIG. 4 is a top view of the chassis of FIG. 1.
Figure 5:
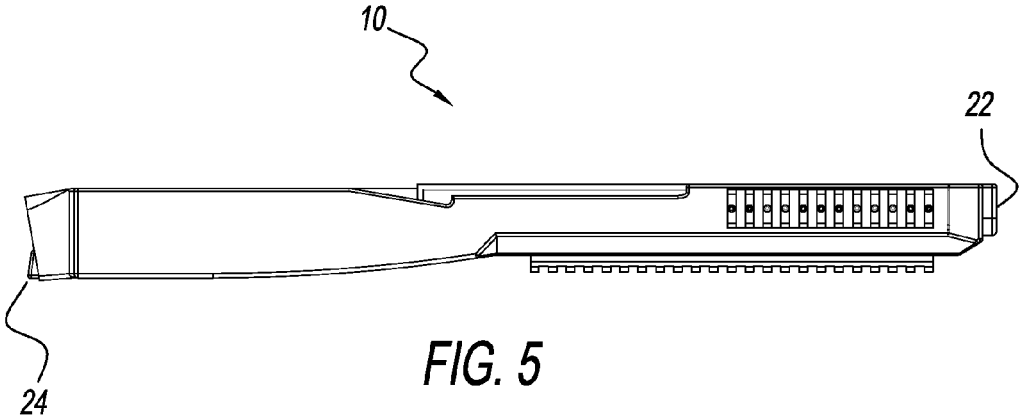
FIG. 5 is a right side view of the chassis of FIG. 1.
Figure 6:
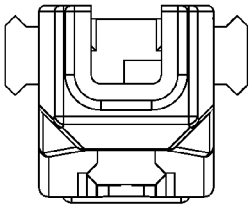
FIG. 6 is a back end view of the chassis of FIG. 1.
Figure 7:
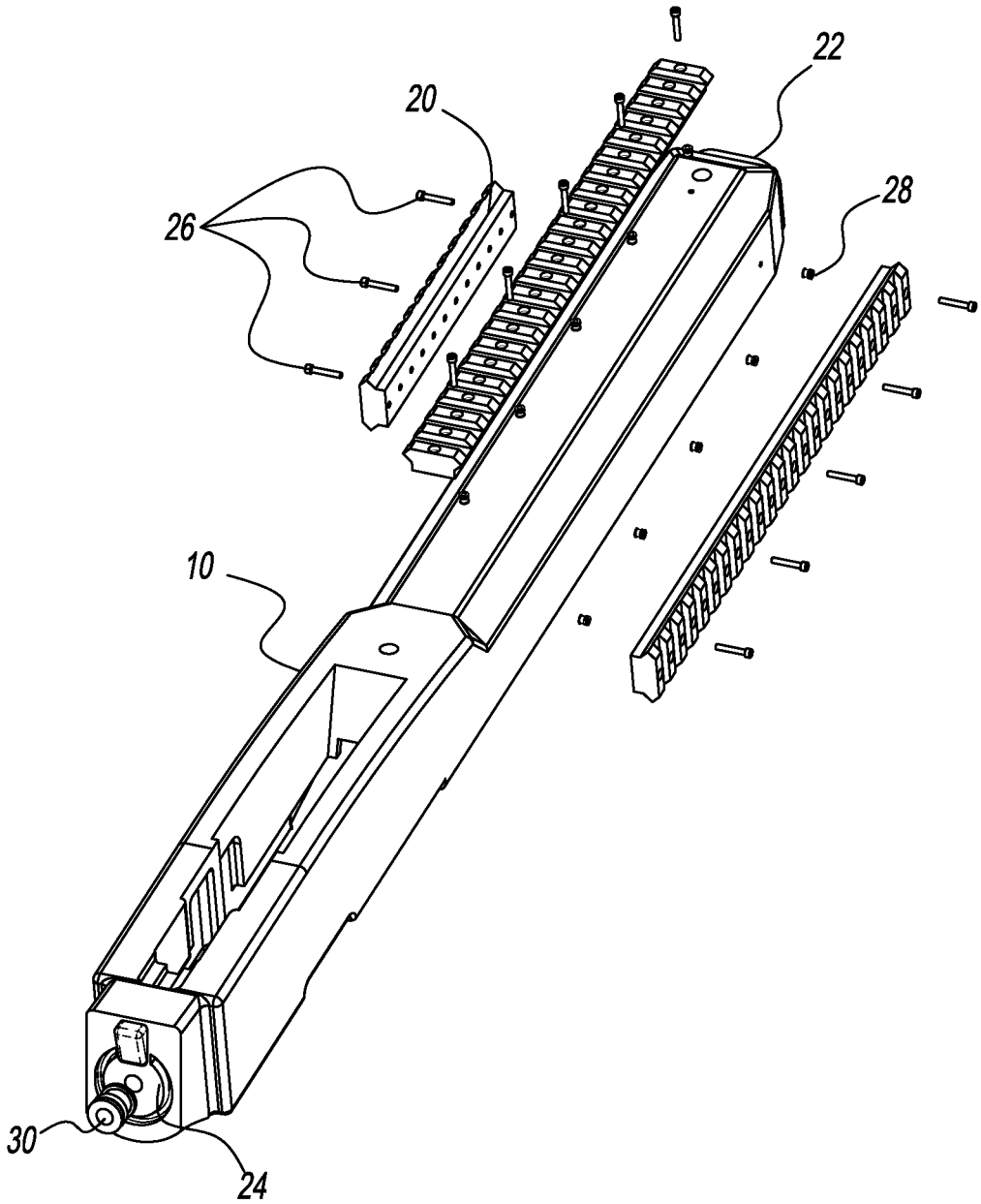
FIG. 7 is an exploded bottom left side perspective view of the chassis of FIG. 1.

Referring to FIG. 1, a rifle 14 may have a rifle chassis 10, such as a M1A rifle chassis, according to an exemplary embodiment of the present invention that ends at a back side of an action 12 of the rifle 14. A back end 16 of the chassis 10 may be adapted to attach to a shotgun stock 18, such as a Mossberg® model 500 shotgun stock. There are limited stocks available for the M1A rifle and changing such stocks require removing the action and reassembling the rifle. On the other hand, there are a relatively large variety of shotgun stocks available. By providing the chassis 10 of the present invention, a rifle user may have a variety of stocks available for use.

Referring now to FIGS. 1 through 7, a rail system 20, such as a MIL-STD 1913 Picatinny rail, may be attached to the sides and bottom of the chassis 10 at a barrel end 22 thereof. The rail system 20 may attach to the chassis 10 via mounting hardware, such as screws 26 that may fit into threaded bushings 28 molded into the chassis 10.

A receiver end 24 of the chassis 10 may have an angle 32 to provide a drop in the stock 18 to the chassis 10. The angle 32 may be measured as an angle which a lengthwise axis 34 of the chassis 10 drops at the receiver end 24 thereof. The angle may be from about 10 to about 20 degrees. This drop may permit the user to use the iron sights 34 of the rifle 14. In conventional stocks for the M1A rifle, the profile line may be too high and the shooter must use an optic system.

The receiver end 24 may include a molded T-nut 30 for mounting the stock 18. The stock 18 may be changed with a single tool, i.e., a nut driver, an Allen wrench, or the like. The stock 18 may be held to the chassis 10 with a single bolt (not shown). The chassis has the T-nut 30 and the stock 18 has a hole that a bolt may go through to claim the T-nut 30. The chassis 10 may mount to the action assembly in the same manner as an original M1A rifle stock. The chassis 10 of the present invention may provide options of stocks that are currently not available to the rifle owner.

The chassis 10 may be made as a single-piece finished product that may be produced by molding, casting, machining, or the like, according to methods known in the art. The end result is a chassis 10 that may use a stock 18 from other manufacturer's aftermarket lines. For example, the Mossberg® model 500 shotgun stock may be mounted on the chassis 10 to solve problems of both 1) the distance to trigger group, as well as 2) the proper angle for stock drop for the use of the iron sights of the rifle.

The chassis 10 may be installed similar to the original rifle stock. First, the top action may be installed in the chassis 10. Next, the trigger group may be installed and locked. Finally, a stock from a variety of Mossberg® model 500 stocks in the aftermarket world may be mounted to the chassis 10 by a single bolt in the back of the chassis 10.

It should be understood, of course, that the foregoing relates to exemplary embodiments of the invention and that modifications may be made without departing from the spirit and scope of the invention as set forth in the following claims.

What is claimed is:

1. A rifle design comprising:

a M1A-type rifle chassis extending to a back end of an action of the rifle, the chassis configured to accept M1A-type rifle top action and trigger group, the chassis being absent of a butt stock, wherein M1A Rifles are gas-operated, semi-automatic rifles; and a receiver end of the chassis configured to accept aftermarket shotgun stocks interchangeably attachable thereto, wherein the aftermarket shotgun stocks are configured to mount on a Mossberg® 500 brand shotgun, wherein the Mossberg® 500 series shotguns are hammerless repeater, pump-action shotguns.

2. The rifle design of claim 1, wherein the receiver end is angled at an angle downward relative to a lengthwise axis of the chassis.

3. The rifle design of claim 2, wherein the angle is from about 10to about 20degrees.

4. The rifle design of claim 1, further comprising a rail system attached to the chassis.

5. The rifle design of claim 1, further comprising a T-nut molded onto the receiver end, the T-nut adapted to secure the aftermarket stocks thereto.

6. A M1A-type rifle chassis, the chassis being absent of a butt stock and the chassis comprising:

a receiver end configured to accept aftermarket shotgun stocks interchangeably attachable thereto, wherein the aftermarket shotgun stocks are configured to mount on a Mossberg® 500 brand shotgun, wherein the Mossberg® 500 brand shotgun is a hammerless repeater, pump-action shotgun, and M1A Rifles are gas-operated, semi-automatic rifles.

7. The rifle chassis of claim 6, wherein an action of the rifle is adapted to be installed in the chassis.

8. The rifle chassis of claim 6, wherein the receiver end is angled downward relative to a lengthwise axis of the chassis.

9. The rifle chassis of claim 6, further comprising a rail system attached to the chassis.

10. The rifle chassis of claim 6, further comprising a T-nut molded onto the receiver end, the T-nut adapted to secure the aftermarket stocks thereto.

11. A rifle comprising:

a M1A-type rifle chassis having a receiver end, the chassis being absent of a butt stock, wherein M1A Rifles are gas-operated, semi-automatic rifles;

a rifle action mounted into the chassis; and an interchangeable aftermarket shotgun stock removably attached to the receiver end of the rifle chassis, wherein the aftermarket shotgun stock is configured to mount on a Mossberg® 500 brand shotgun, wherein the Mossberg® 500 series shotguns are hammerless repeater, pump-action shotguns.

12. The rifle of claim 11, wherein the receiver end is angled downward relative to a lengthwise axis of the chassis.

13. The rifle of claim 11, further comprising a rail system attached to the chassis.

14. The rifle of claim 11, further comprising a T-nut molded onto the receiver end, the T-nut adapted to secure the aftermarket stocks thereto.

15. The rifle of claim 11, wherein the aftermarket stock is a shotgun stock.

* * * * *